US006860803B2

(12) United States Patent
Noguchi

(10) Patent No.: US 6,860,803 B2
(45) Date of Patent: Mar. 1, 2005

(54) POLISHING PLATE

(75) Inventor: Hitoshi Noguchi, Gunma (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/269,313

(22) Filed: Oct. 11, 2002

(65) Prior Publication Data

US 2003/0073393 A1 Apr. 17, 2003

(30) Foreign Application Priority Data

Oct. 15, 2001 (JP) ..... 2001-317080

(51) Int. Cl.[7] ..... B23F 21/03
(52) U.S. Cl. ..... 451/540; 451/41
(58) Field of Search ..... 451/540, 548, 451/41, 64, 65; 438/479

(56) References Cited

U.S. PATENT DOCUMENTS 5,247,765 A * 9/1993 Quintana ..... 451/548
6,193,585 B1 * 2/2001 Tanabe et al. ..... 451/41
6,428,399 B1 * 8/2002 Tanabe et al. ..... 451/66
6,439,986 B1 * 8/2002 Myoung et al. ..... 451/443
6,592,436 B1 * 7/2003 Abe et al. ..... 451/64
2002/0039831 A1 * 4/2002 Usuda ..... 438/479

FOREIGN PATENT DOCUMENTS

WO 00/78504 12/2000

* cited by examiner

*Primary Examiner*—Lee D. Wilson
(74) *Attorney, Agent, or Firm*—Hogan & Hartson, LLP

(57) ABSTRACT

There is disclosed a polishing plate for polishing a workpiece by rubbing the workpiece to be processed with the polishing plate, comprising at least a substrate and a polishing material, the polishing material being a vapor phase synthetic polycrystalline diamond film deposited on a surface of the substrate to rub the workpiece to be processed. The present invention provides a polishing plate of which production cost is low and which can effectively polish a surface of a workpiece to be processed comprising a very hard material such as DLC, SiC, SiN, Si or the like and extremely smooth the surface.

18 Claims, 3 Drawing Sheets

POLISHING PLATE

BACKGROUND OF INVENTION

1. Field of the Invention

The present invention relates to a polishing plate for polishing a workpiece by rubbing the workpiece to be polished with it, specifically a polishing plate for smoothing a hard material such as a diamond like carbon and the like.

2. Description of the Related Art

A diamond like carbon (DLC), silicon carbide (SiC), silicon nitride (SiN), silicon (Si) or the like has been frequently used as an electronic material. Particularly, since DLC has characteristics similar to a diamond and further there can be obtained a thin film thereof which is dense and large in area as compared to that of diamond, it is expected that DLC is used for various purposes as functional materials. As a practical use, for example, it has been considered that DLC is used as a protection film for a magnetic disk, a protection film for an optical component, and the like.

These electronic materials have Knoop hardness (kgf/$mm^2$) of about 2000–5000 for DLC, about 3000–4000 for SiC, about 1800 for SiN and about 1200 for Si, respectively, and thus each of them is very hard.

For example, a DLC film formed on a magnetic disk surface is necessary to be smoothed in practical use. Conventionally, a DLC film has been smoothed by rubbing a surface thereof to be polished with a resin pad soaked with a polishing agent containing particles such as synthetic diamond, SiC, SiN, or $SiO_2$ and dispersion medium.

However, in this method, since the polishing agent is easy to escape and is not uniformly applied to the surface to be polished, there are problems that uniformity in the processed surface is bad and its processing efficiency is also bad.

Alternatively, it is suggested that polishing is performed using a polishing tool wherein synthetic diamond particles is adhered to a substrate by an adhesive or by an electrolytic method. However, synthetic diamonds, which have minute particle sizes possible to smooth surface roughness of a surface to be polished to 50 nm or less in Ra, are difficult to be uniformly adhered to a substrate, still less it is impossible to prepare a tool having a size of 50 mm or more in diameter, which can correspond to polishing of a material having a large area. Additionally, synthetic diamond particles having a minute size used as a material in themselves are expensive and process for adhering is complicated, so that there is also a problem in terms of a production cost of the tool.

SUMMARY OF THE INVENTION

The present invention has been accomplished to solve the foregoing problems, and its object is to provide a polishing plate of which production cost is low and which can effectively polish a surface of a workpiece to be processed comprising a very hard material such as DLC, SiC, SiN, Si or the like and extremely smooth the surface.

To achieve the above mentioned object, the present invention provides a polishing plate for polishing a workpiece by rubbing the workpiece to be polished with the polishing plate, comprising at least a substrate and a polishing material, the polishing material being a vapor phase synthetic polycrystalline diamond film deposited on a surface of the substrate to rub the workpiece to be processed.

As described above, if the vapor phase synthetic polycrystalline diamond film as a polishing material is deposited on the surface of the substrate, there can be provided the polishing plate of which production cost is low and in which diamonds of the hardest material (Knoop hardness: 10000) are formed on the substrate surface having various shapes so that the formed diamond film has a desired surface roughness and thickness, good uniformity, and large area. And according to such a polishing plate, polishing can be performed effectively even when a hard material is polished, and moreover the polished surface can be extremely smoothed.

It is preferable that surface roughness or the vapor phase synthetic polycrystalline diamond film used as the polishing material is 0.1–500 nm in Ra.

Surface roughness of the vapor phase synthetic polycrystalline diamond film may be determined depending on finish surface roughness required for a workpiece to be processed. However, if surface roughness of the diamond film is within the above range, even an electronic material which requires very high flatness, for example, can be finished to have an extremely smooth surface, and the diamond films having different roughness can be appropriately used depending on each purpose.

Also, it is preferable that the vapor phase synthetic polycrystalline diamond film is 0.5–100 $\mu$m in thickness.

Since a thickness of the diamond film used as a polishing material relates to the life of the polishing plate, the thickness may be determined depending on its purpose and life to be required. However, if the diamond film having a thickness of the above range is formed, the excellent polishing effect can be shown over the long period even when the polishing plate is used for polishing of hard materials.

As for the substrate, it is preferable that the substrate is a disc type wafer or a disc type wafer with a notch or an orientation flat.

The shape or the like of the substrate according to the present invention is not in particular limited to anything. However, since disk type wafers or the like is easily available, the production cost can be further lowered. Also, if a semiconductor wafer, which has proper hardness and very flat surface, is used for a substrate, when polishing of a workpiece is performed by using the polishing plate produced by depositing the vapor phase synthetic polycrystalline diamond film on the wafer, the polished workpiece can be extremely smoothed.

Also, it is preferable that the substrate is made of silicon, silicon oxide, silicon nitride, silicon carbide or silicon coated with silicon oxide, silicon nitride or silicon carbide.

The material of the substrate may be appropriately selected depending on material of a workpiece to be processed or type of polishing liquid used in polishing. However, if the substrate made of the above material is employed, there can be provided a polishing plate having excellent mechanical characteristics or the like, in addition, having the vapor phase polycrystalline diamond film with high adhesiveness, which is deposited on the substrate surface with comparative ease.

Moreover, it is preferable that a groove pattern is formed at least in a surface of the substrate to rub the workpiece to be processed, and particularly the groove pattern has a depth of 5 $\mu$m or more.

If the groove pattern is formed in the substrate as described above, the groove pattern is reflected on the polishing plate on which the diamond film was deposited. When polishing is performed by using such a polishing plate, since polishing wastes and polishing agent or polishing liquid such as alkaline solution are effectively eliminated through the groove from its polishing surface, the polished surface can be extremely smoothed without causing unevenness of polishing or the like, and also efficiency of polishing can be improved.

As described above, the polishing plate of the present invention is a low cost polishing plate having a large area of diamond film. In the case that polishing is performed by using such a polishing plate, even if a workpiece to be polished is made of very hard material such as DLC, SiC, SiN, Si, or the like, the polishing can be effectively performed at low cost and the polished surface can be extremely smoothed.

DESCRIPTION OF THE INVENTION AND A PREFERRED EMBODIMENT

The present invention will be further described below in detail, but the present invention is not limited thereto.

Figure 1:
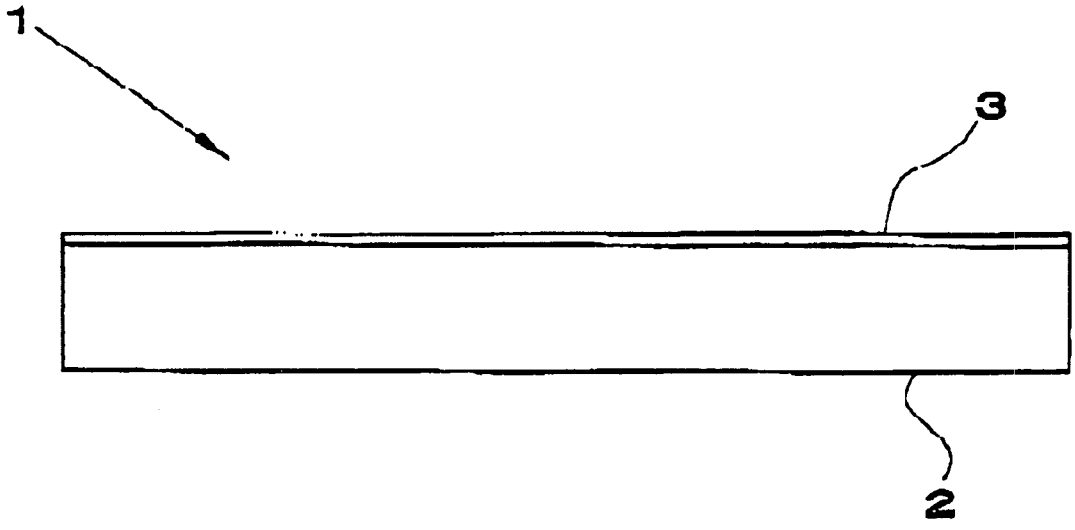
FIG. 1 is a schematic view showing one example of a polishing plate according to the present invention.

FIG. 1 is a schematic view showing one example of a polishing plate according to the present invention. A polishing plate 1 comprises a substrate 2 being a silicon wafer and a polishing material 3, and a vapor phase synthetic polycrystalline diamond film used as a polishing material is uniformly deposited on a surface of the substrate 2 to rub a workpiece to be processed with.

A production method of the polishing plate (diamond abrasive disc) of the present invention is not in particular limited. However, as for a method of forming a vapor phase synthetic polycrystalline diamond film, for example, a method utilizing DC arc discharge, DC glow discharge, combustion flame, radio frequency (R.F.), hot filament or the like have been known. Particularly, by a microwave CVD method and a hot filament CVD method, a hard polycrystalline diamond film having a large area and good crystallinity can be deposited.

Figure 4:
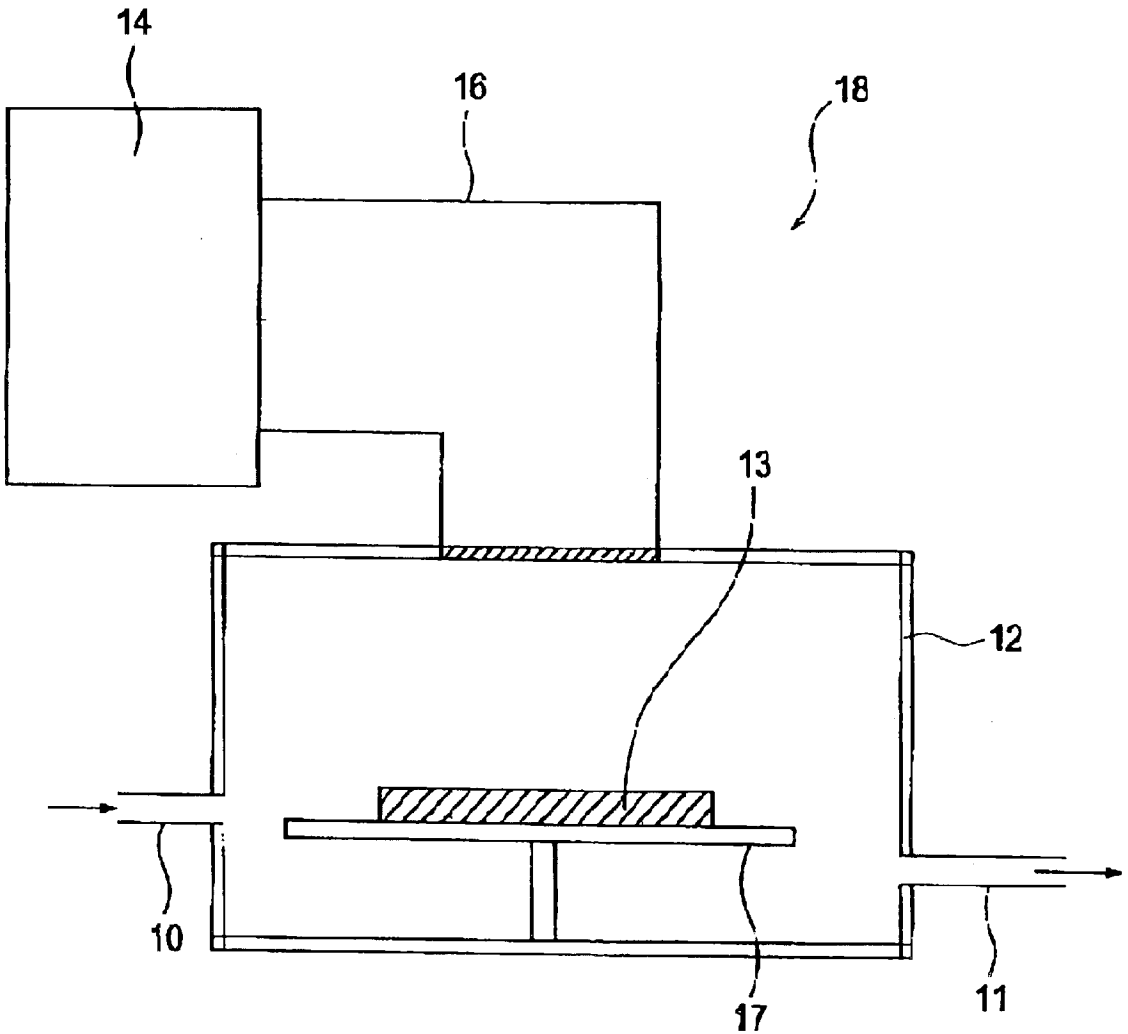
FIG. 4 is a schematic view showing a microwave CVD apparatus for depositing a vapor phase synthetic polycrystalline diamond film on a substrate (wafer) surface.

FIG. 4 is a schematic view showing a typical apparatus 18 according to a microwave CVD method used for depositing a vapor phase synthetic polycrystalline diamond film on a substrate.

A substrate 13 such as a wafer is set on a base 17 disposed inside a chamber 12 provided with a gas inlet pipe 10 and a gas outlet pipe 11, and the pressure inside the chamber 12 is reduced to $10^{-3}$ Torr or less through a vacuum pump. Next, a source gas, e.g., methane gas diluted with hydrogen is introduced into the chamber 12 from the gas inlet pipe 10. Next, after the inside of the chamber 12 is controlled to be about 30 Torr, for example, by adjusting a valve provided in the gas outlet pipe 11, a microwave is applied from a microwave source 14 through a waveguide 16 to generate plasma above the substrate 13. By this way, synthetic diamonds having a minute particle size can be uniformly formed on the substrate surface and thereby a diamond film is grown.

Also, before formation of the diamond film, if there is performed a pre-treatment for seeding diamond particles such that a diamond slurry is applied to the substrate surface, or the substrate surface is subjected to supersonic treatment using a diamond slurry, scratch treatment using diamond particles, treatment using a fluidized bed containing diamond particles or the like, the nuclei generation density of diamonds is improved and a continuous film having a uniform particle size and large area can be suitably formed even when its film thickness is thin. If the diamond film is grown on the substrate as described above, a tool having a size of 50 mm or more in diameter, which is conventionally unknown, can be obtained.

In the polishing plate of the present invention, a diamond film to be required may be formed under the most suitable condition depending on the purpose of polishing process, i.e., depending on a material or finish surface roughness of a workpiece to be processed. However, as a result of various studies, if surface roughness of the vapor phase synthetic polycrystalline diamond film used as a polishing material is in the range of 0.1–500 nm in Ra, even DLC used as a protection film of a magnetic disk can be finished to have its surface roughness Ra of 50 nm or less. Also, the thickness of the diamond film mainly relates to the life of the polishing plate. If the thickness is in the range of 0.5–100 $\mu$m, production cost can be lowered, in addition, polishing effect can be exerted over a long period, and even a hard material such as DLC can be extremely smoothed.

In order to obtain the vapor phase synthetic polycrystalline diamond film having the above-described surface roughness and film thickness, by controlling composition and pressure of a source gas, applied voltage, time for forming a film or the like in the aforementioned production of a diamond film, a desired surface roughness and film thickness can be obtained.

Since shape and material of a substrate are not in particular limited as long as a vapor phase synthetic polycrystalline diamond film can be formed thereon and the product can be used as a polishing plate, a substrate may be appropriately selected depending on shape and material of a workpiece to be processed.

For example, as for shape of the substrate, it is preferable that the substrate is a disc type wafer or a disc type wafer with a notch or orientation flat formed in the wafer. For example, since a disk type wafer is easily available in semiconductor industries, the production cost can be lowered. Also, since a silicon wafer has very flat surface, the vapor phase synthetic polycrystalline diamond film deposited thereon can also become extremely flat. Therefore, if polishing is performed by using such a polishing plate, the polished workpiece can be extremely smoothed.

Also, the material of the substrate may be appropriately selected depending on material of a workpiece to be processed or type of polishing liquid used in polishing, i.e., depending on the required mechanical, electrical and chemical characteristics. However, if a substrate made of silicon, silicon oxide, silicon nitride, silicon carbide or silicon coated with silicon oxide, silicon nitride or silicon carbide is employed, the substrate has excellent mechanical characteristics, in addition, the vapor phase synthetic polycrystalline diamond film can be disposed on the substrate surface with comparative ease and shows good adhesiveness. Furthermore, a substrate made of combination of the above materials may also be used.

Moreover, if a desired groove pattern is formed in a surface of the substrate with which a workpiece to be processed is rubbed, the groove pattern is reflected on the polishing plate, promotes removal of polishing wastes during polishing, and therefore is effective to improve uniformity of polishing and polishing efficiency.

Figure 2:
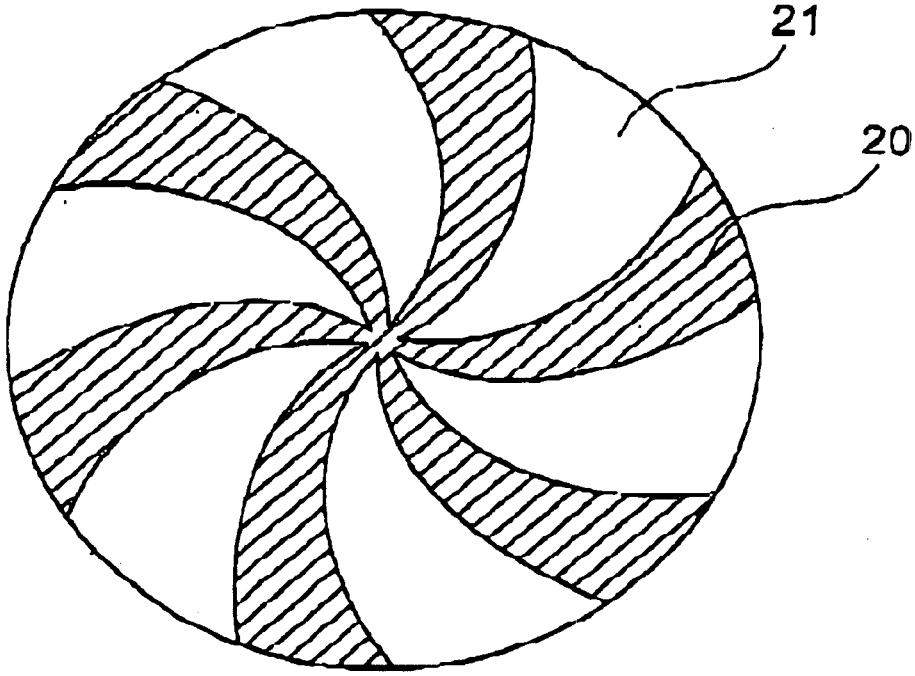
FIG. 2 shows one example of a groove pattern formed in a substrate surface.
Figure 3:
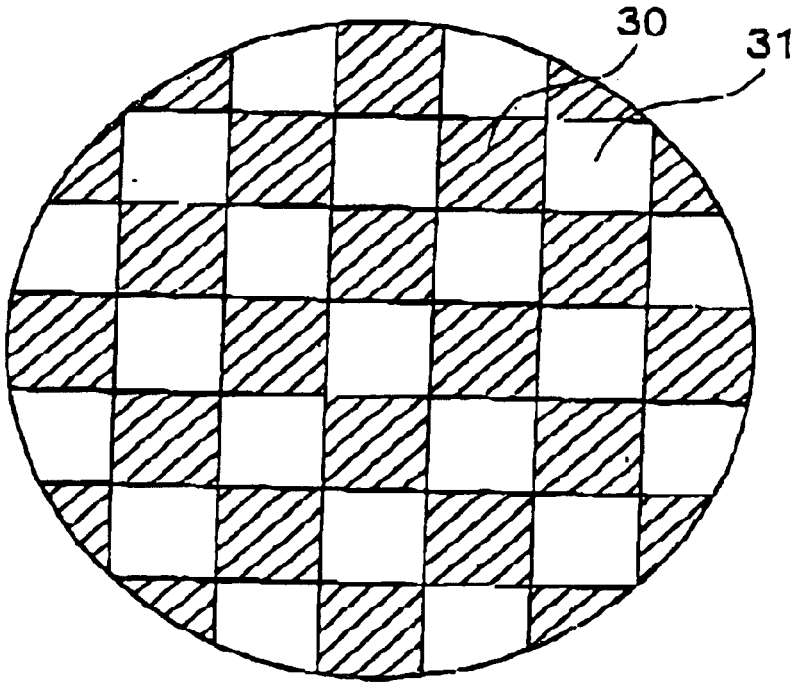
FIG. 3 shows another example of a groove pattern formed in a substrate surface.

Each of FIGS. 2 and 3 shows one example of a groove pattern formed on the surface to rub a workpiece to be processed.

In FIG. 2, a groove pattern 20 radiating from the center of a polishing plate is formed therein. Polishing liquid supplied during polishing is uniformly dispersed by the groove 20 and unwanted polishing wastes easily escape to the outside through the groove 20. If polishing is performed by rotating clockwise the polishing plate in which such a groove pattern is formed and rubbing a workpiece to be polished with the polishing plate while supplying polishing liquid, the workpiece can be finished to have an extremely smooth surface without causing unevenness of polishing or the like on the polished surface.

On the other hand, a groove pattern 30 shown in FIG. 3 is so-called checkered pattern. Since the polishing plate having such a groove pattern 30 also has effects of uniformly dispersing a polishing liquid through the groove 30 and eliminating polishing wastes and polishing agent or polishing liquid, polishing process can be effectively performed without generation of unevenness of polishing on the processed surface.

Shape of the groove pattern is not limited to the above patterns and may be determined appropriately. However, as a result of experiments, it is found that if there is employed a polishing plate having a groove pattern which has a depth (depth of the groove) of 5 $\mu$m or more from a contact surface 21, 31 of the polishing plate to be brought into contact with a surface to be polished, i.e., the most convex portion of the polishing plate, to the deepest portion of the escape groove and which has a structure such that polishing wastes and polishing agent or polishing liquid easily escape, extremely uniform polishing can be performed.

The polishing plate having the above-described structure can be produced at low cost, and by using the polishing plate, a surface of a very hard material can be effectively polished and the polished surface can be extremely smoothed.

EXAMPLE

Hereinafter, the present invention will be specifically described by giving examples and comparative example.

Example 1

As a substrate, a double-sided polished single crystal silicon wafer having a diameter of 100 mm, a thickness of 2 mm and orientation of <100> was prepared, and the wafer was subjected to pre-treatment in a fluidized bed of diamond particles (means particle size: 400 $\mu$m) in order to improve nuclei generation density of synthetic diamonds.

After the above treatment, the substrate (wafer) was set on a base 17 inside a chamber 12 of a microwave CVD apparatus 18 as shown in FIG. 4. Next, after the chamber 18 was exhausted in a decompression state of $10^{-3}$ Torr or less through a rotary pump, a mixed gas composed of methane gas and hydrogen gas was supplied from a gas inlet pipe. As for each gas, methane gas was 20 sccm and hydrogen gas was 980 sccm, and a volume ratio of them was set to be methane gas/hydrogen gas=2/98. And then, the inside of the chamber was controlled to be 30 Torr by adjusting a valve provided in the gas outlet pipe, plasma was generated by applying a microwave of 3000 W, and thereby formation of a diamond film on the substrate is performed for 10 hours. During formation of the diamond film, the substrate generated heat due to microwave absorption and its surface temperature reached 850° C.

The formed diamond film was a continuous film having a thickness of about 5.0 $\mu$m and a surface roughness Ra of 21.1 nm, and had extremely good uniformity as a whole.

The polishing plate as produced above was fixed in a polishing plate mounting shaft of a polishing apparatus by using wax. On the other hand, as a workpiece to be polished, a magnetic disk on a top surface of which DLC film having a thickness of 0.2 $\mu$m is formed (DLC coating magnetic disk) was prepared, and the magnetic disk was held on its one side surface through vacuum sucking. Polishing was performed by lightly rubbing the magnetic disk with the polishing plate while supplying an alkaline solution between the polishing plate and the magnetic disk.

As a result, the DLC surface having a surface roughness Ra of about 100 nm before polishing could be smoothed up to surface roughness Ra of 3 nm through a 10-minute polishing. Also, distribution of the surface roughness was ±20% with respect to its average value in a diameter of 50 mm.

That is, if polishing was performed using the above polishing plate, the DLC surface could be extremely smoothed and polishing uniformity was very excellent.

Example 2

As a substrate, there was prepared a double-sided polished single crystal silicon wafer having a diameter of 100 mm, a thickness of 2 mm and orientation of <100>and having a groove pattern shown in FIG. 2, which has a depth of 0.5 mm and is formed in its one side surface. And then, a diamond film was disposed on the substrate as in Example 1 so that a polishing plate was produced.

By using this polishing plate, a surface of a DLC coating magnetic disk was polished as in Example 1. As a result, the DLC surface having a surface roughness Ra of 100 nm before polishing could be smoothed up to a surface roughness Ra of 3 nm through a 5-minute polishing. Also, distribution of the surface roughness was ±5% with respect to its average value in a diameter of 50 mm.

Example 3

As a substrate, there was prepared a double-sided polished single crystal silicon wafer having a diameter of 100 mm, a thickness of 2 mm and orientation of <100>and having a groove pattern shown in FIG. 3, which has a depth of 0.5 mm and is formed in its one side surface. And then, a diamond film was disposed on the substrate as in Example 1 so that a polishing plate was produced.

By using this polishing plate, a surface of a DLC coating magnetic disk was polished as in Example 1. As a result, the DLC surface having a surface roughness Ra of 100 nm before polishing could also be smoothed up to a surface roughness Ra of 3 nm through a 5-minute polishing. Also, distribution of the surface roughness was ±6% with respect to its average value in a diameter of 50 mm.

Comparative Example

A surface of a DLC coating magnetic disk was polished by a chemical and mechanical polishing (CMP) method. Specifically, smoothing was performed by bringing the surface of the DLC coating magnetic disk into contact with a resin pad containing a polishing agent prepared by dispersing cluster diamonds having an average particle size of 50 nm in a alkaline solution of pH=10.

As a result, the DLC surface having Ra of 100 nm before polishing was only smoothed up to Ra of 60 nm even through a 240-minute polishing. Also, distribution of the surface roughness was ±26% with respect to its average value in a diameter of 50 mm.

The Other Examples

Table 1 shows polishing plates produced in the other examples, polishing conditions in cases of using the polishing plates, and thereby obtained result (surface roughness and surface roughness distribution of the workpieces after polishing) in the whole. The polished workpieces were DLC coating magnetic disks similar to those used in Examples 1–3.

TABLE 1

| | Surface roughness RA of diamond film | | | | | | | | | |
|---|---|---|---|---|---|---|---|---|---|---|
| | 21 nm | | | | | 550 nm | | | | |
| | Groove pattern | | | | | | | | | |
| | None (Flat) | A | | B | | None (Flat) | A | | B | |
| | Depth of groove | | | | | | | | | |
| | 0 μm | Under 5 μm | 5 μm or more | Under 5 μm | 5 μm or more | 0 μm | Under 5 μm | 5 μm or more | Under 5μ | 5 μm or more |
| Surface roughness RA of DLC film after 10 minutes polishing | 3 nm | 3 nm | 1 nm | 3 nm | 1 nm | 49 nm | 49 nm | 45 nm | 49 nm | 45 nm |
| Surface roughness distribution in diameter of 50 mm | ±20% | ±20% | ±5% | ±20% | ±6% | ±22% | ±22% | ±6% | ±22% | ±6% |

As evident from results of the above Examples 1–3 and Table 1, in the case that polishing was performed by using a polishing plate having a vapor phase synthetic polycrystalline diamond film formed on a surface thereof, with which a workpiece to be processed is rubbed, surface roughness of the DLC film could be extremely improved, regardless of a short period of polishing time rather than in the case of polishing performed by the chemical and mechanical polishing (CMP) method employed in the comparative example. Also, distribution of surface roughness in each surface polished in Examples 1–3 was smaller than that in the comparative example. Particularly, all of surface roughness of the surface polished in Examples 1–3 could be smoothed up to 50 nm or less in Ra.

The present invention is not limited to the above-described embodiments. The above-described embodiments are mere examples, and those having the substantially same structure as that described in the appended claims and providing the similar action and effects are included in the scope of the present invention.

For example, in the foregoing it is exemplified that a vapor phase synthetic polycrystalline diamond film used as a polishing material is formed only on one side of a substrate. However, the present invention is not limited thereto, and there may be used a polishing plate such that a vapor phase synthetic polycrystalline diamond film is formed on both sides or whole surface of a substrate.

What is claimed is:

1. A polishing plate for polishing a workpiece by rubbing the workpiece to be processed with the polishing plate, comprising at least a substrate and a polishing material, the polishing material being a vapor phase synthetic polycrystalline diamond film deposited on a surface of the substrate to rub the workpiece to be processed.

2. The polishing plate according to claim 1, wherein the vapor phase synthetic polycrystalline diamond film as the polishing material has a surface roughness Ra of 0.1–500 nm.

3. The polishing plate according to claim 2, wherein the vapor phase synthetic polycrystalline diamond film as the polishing material has a thickness of 0.5–100 μm.

4. The polishing plate according to claim 3, wherein the substrate is one of a disc type wafer, a disc type wafer with a notch, and a disc type wafer with orientation flat.

5. The polishing plate according to claim 4, wherein the substrate is made of one of silicon, silicon oxide, silicon nitride, silicon carbide, silicon coated with silicon oxide, silicon coated with silicon nitride, and silicon coated with silicon carbide.

6. The polishing plate according to claim 3, wherein the substrate is made of one of silicon, silicon oxide, silicon nitride, silicon carbide, silicon coated with silicon oxide, silicon coated with silicon nitride, and silicon coated with silicon carbide.

7. The polishing plate according to claim 2, wherein the substrate is one of a disc type wafers, a disc type wafer with a notch, and a disc type wafer with orientation flat.

8. The polishing plate according to claim 7, wherein the substrate is made of one of silicon, silicon oxide, silicon nitride, silicon carbide, silicon coated with silicon oxide, silicon coated with silicon nitride, and silicon coated with silicon carbide.

9. The polishing plate according to claim 2, wherein the substrate is made of one of silicon, silicon oxide, silicon nitride, silicon carbide, silicon coated with silicon oxide, silicon coated with silicon nitride, and silicon coated with silicon carbide.

10. The polishing plate according to claim 1, wherein the vapor phase synthetic polycrystalline diamond film as the polishing material has a thickness of 0.5–100 μm.

11. The polishing plate according to claim 10, wherein the substrate is one of a disc type wafer, a disc type wafer with a notch, and a disc type wafer with orientation flat.

12. The polishing plate according to claim 11, wherein the substrate is made of one of silicon, silicon oxide, silicon nitride, silicon carbide, silicon coated with silicon oxide, silicon coated with silicon nitride, and silicon coated with silicon carbide.

13. The polishing plate according to claim 10, wherein the substrate is made of one of silicon, silicon oxide, silicon nitride, silicon carbide, silicon coated with silicon oxide, silicon coated with silicon nitride, and silicon coated with silicon carbide.

14. The polishing plate according to claim 1, wherein the substrate is one of a disc type wafer, a disc type wafer with a notch, and a disc type wafer with orientation flat.

15. The polishing plate according to claim 14, wherein the substrate is made of one of silicon, silicon oxide, silicon nitride, silicon carbide, silicon coated with silicon oxide, silicon coated with silicon nitride, and silicon coated with silicon carbide.

16. The polishing plate according to claim 1, wherein the substrate is made of one of silicon, silicon oxide, silicon nitride, silicon carbide, silicon coated with silicon oxide, silicon coated with silicon nitride, and silicon coated with silicon carbide.

17. The polishing plate according to any one of claims 1–5, wherein a groove pattern is formed at least in the surface of the substrate to rub the workpiece to be processed.

18. The polishing plate according to claim 17, wherein the groove pattern has a depth of 5 $\mu$m or more.

* * * * *